US008525762B2

(12) United States Patent
Lin et al.

(10) Patent No.: US 8,525,762 B2
(45) Date of Patent: Sep. 3, 2013

(54) SYSTEMS AND METHODS FOR ADJUSTING DISPLAY PARAMETERS OF AN ACTIVE MATRIX ORGANIC LIGHT EMITTING DIODE PANEL

(75) Inventors: Ching-Wei Lin, Tou-Yuan Hsien (TW); Ting-Kuo Chang, Hsin-Chu (TW)

(73) Assignee: InnoLux Corporation, Jhu-Nan Site, Hsinchu Science Park, Jhu-Nan, Miao-Li County (TW)

( * ) Notice: Subject to any disclaimer, the term of this patent is extended or adjusted under 35 U.S.C. 154(b) by 887 days.

(21) Appl. No.: 11/600,962

(22) Filed: Nov. 16, 2006

(65) Prior Publication Data

US 2008/0117142 A1 May 22, 2008

(51) Int. Cl.
*G09G 3/32* (2006.01)

(52) U.S. Cl.
USPC ..... 345/82

(58) Field of Classification Search
USPC ..... 345/76–86, 204–211; 348/690, 348/223, 655
See application file for complete search history.

(56) References Cited

U.S. PATENT DOCUMENTS

| | | | | |
|---|---|---|---|---|
| 5,528,248 | A * | 6/1996 | Steiner et al. | 342/357.06 |
| 6,677,958 | B2 * | 1/2004 | Cottone et al. | 345/589 |
| 6,774,578 | B2 * | 8/2004 | Tanada | 315/169.4 |
| 2005/0156836 | A1 * | 7/2005 | Yoneyama et al. | 345/76 |
| 2005/0212728 | A1 * | 9/2005 | Miller et al. | 345/76 |
| 2005/0248513 | A1 * | 11/2005 | Hu | 345/76 |
| 2006/0119592 | A1 * | 6/2006 | Wang et al. | 345/204 |
| 2006/0262053 | A1 * | 11/2006 | Lee et al. | 345/76 |

FOREIGN PATENT DOCUMENTS

CN 1664900 9/2005

OTHER PUBLICATIONS

Office Action in related Chinese patent application dated Oct. 27, 2010.

* cited by examiner

*Primary Examiner* — Liliana Cerullo
(74) *Attorney, Agent, or Firm* — Winston Hsu; Scott Margo

(57) ABSTRACT

Systems and methods for adjusting display parameters of an active matrix organic light emitting diode (AMOLED) panel are provided. The method includes obtaining optimum display parameters for subpixels of the AMOLED panel, storing the optimum display parameters in a non-volatile memory, loading the optimum display parameters stored in the non-volatile memory into a static register memory during normal operation of the AMOLED panel, and utilizing the optimum display parameters loaded in the static register memory to drive the AMOLED panel to have optimum color properties while displaying image data.

16 Claims, 4 Drawing Sheets

SYSTEMS AND METHODS FOR ADJUSTING DISPLAY PARAMETERS OF AN ACTIVE MATRIX ORGANIC LIGHT EMITTING DIODE PANEL

BACKGROUND OF THE INVENTION

1. Field of the Invention

The present invention relates to active matrix organic light emitting diode (AMOLED) panels, and more particularly, to a method of adjusting display parameters for AMOLED panels for improving the yield of manufactured AMOLED displays.

2. Description of the Prior Art

When active matrix organic light emitting diode (AMOLED) panels are manufactured, each panel has different electroluminance characteristics, meaning that an image displayed on one AMOLED panel may have different color and luminance values than another AMOLED panel displaying the same image.

Manufactured AMOLED panels need to conform to specific color parameters, and the variation in electroluminance characteristics in manufactured AMOLED panels causes a yield loss during the manufacturing process since not all panels conform to the required color parameters.

SUMMARY OF THE INVENTION

Systems and methods for adjusting display parameters of an active matrix organic light emitting diode (AMOLED) panel are provided. An exemplary embodiment of a method for adjusting white point display parameters of an active matrix organic light emitting diode (AMOLED) panel is disclosed. The method includes obtaining optimum display parameters for subpixels of the AMOLED panel, storing the optimum display parameters in a non-volatile memory, loading the optimum display parameters stored in the non-volatile memory into a static register memory during normal operation of the AMOLED panel, and utilizing the optimum display parameters loaded in the static register memory to drive the AMOLED panel to have optimum color properties while displaying image data.

Another exemplary embodiment of a system for adjusting display parameters of an AMOLED display comprises an AMOLED panel comprising a plurality of pixels, each pixel comprising a plurality of subpixels, a non-volatile memory for storing optimum display parameters for the subpixels of the AMOLED panel, a static register memory for loading the optimum display-parameters stored in the non-volatile memory during normal operation of the AMOLED panel, and a source driver for utilizing the optimum display parameters loaded in the static register memory to drive the AMOLED panel to have optimum color properties while displaying image data.

These and other objectives of the present invention will no doubt become obvious to those of ordinary skill in the art after reading the following detailed description of the preferred embodiment that is illustrated in the various figures and drawings.

DETAILED DESCRIPTION

Systems and methods for adjusting display parameters of an active matrix organic light emitting diode panel will now be described here in greater detail. Some embodiments of the invention, such as the exemplary embodiments described, can potentially ensure that the AMOLED panel is always operated with the best color characteristics, and the optimum display parameters are retained even when the AMOLED display is powered off.

Figure 1:
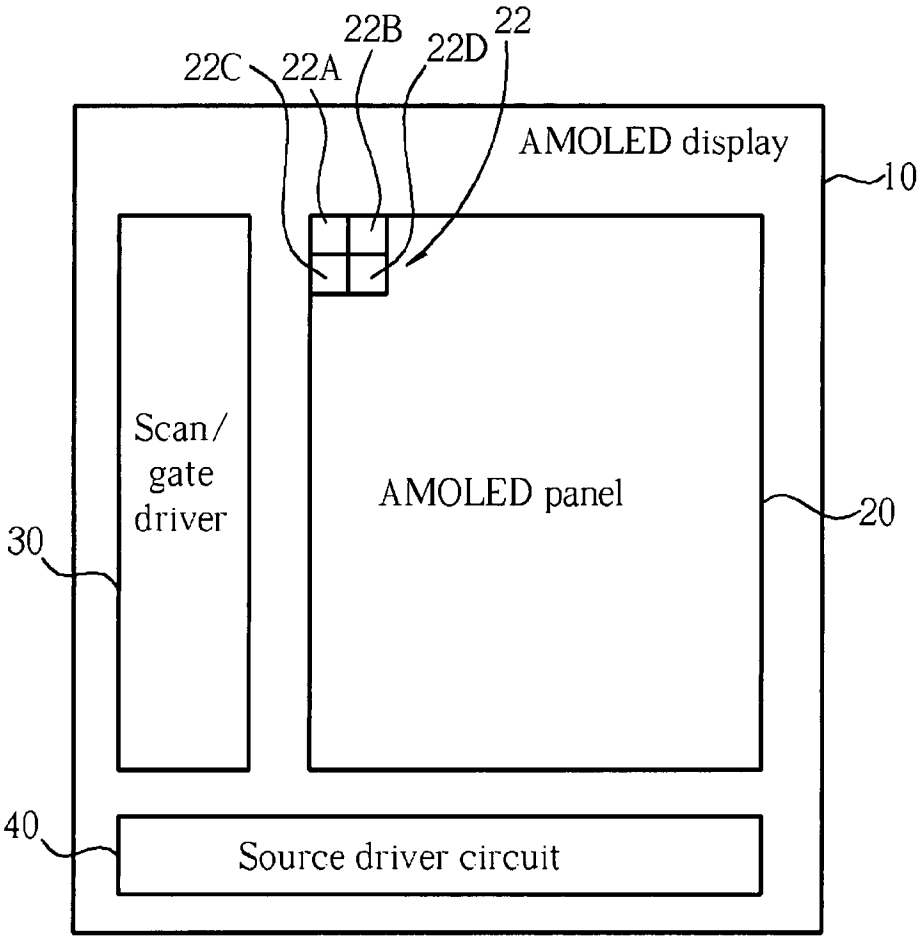
FIG. 1 is a functional block diagram of an active matrix organic light emitting diode (AMOLED) display according to the present invention.

Referring now to the drawings, FIG. 1 is a functional block diagram of an active matrix organic light emitting diode (AMOLED) display 10 according to the present invention. The AMOLED display 10 contains an AMOLED panel 20 comprising a plurality of pixels 22. As is well known in the art, each pixel 22 contains a plurality of subpixels 22A-22C or 22A-22D, depending on whether the pixel 22 contains three or four subpixels. The AMOLED display 10 also contains a scan/gate driver 30 for activating individual pixels 22 and subpixels 22A-22D for displaying images. A source driver circuit 40 is used to supply color information to the subpixels 22A-22D for controlling the pixels 22 to display the correct colors.

When an AMOLED panel 20 is manufactured, the color coordinates of the different sample portions of the panel such as subpixels 22A-22D must be measured for correctly calibrating the color characteristics of the AMOLED panel 20. Depending on the exact color coordinates of the subpixels 22A-22D, the luminance of the respective subpixels 22A-22D must be adjusted to achieve an overall white-point for the whole pixel 22. The luminance values are calculated for the subpixels 22A-22D that allow the respective pixel 22 to display a true white color. After the white-point adjustment, the optimum display parameters are stored so that the AMOLED panel 20 is controlled using the optimum display parameters each time the AMOLED panel is used to display images.

Figure 2:
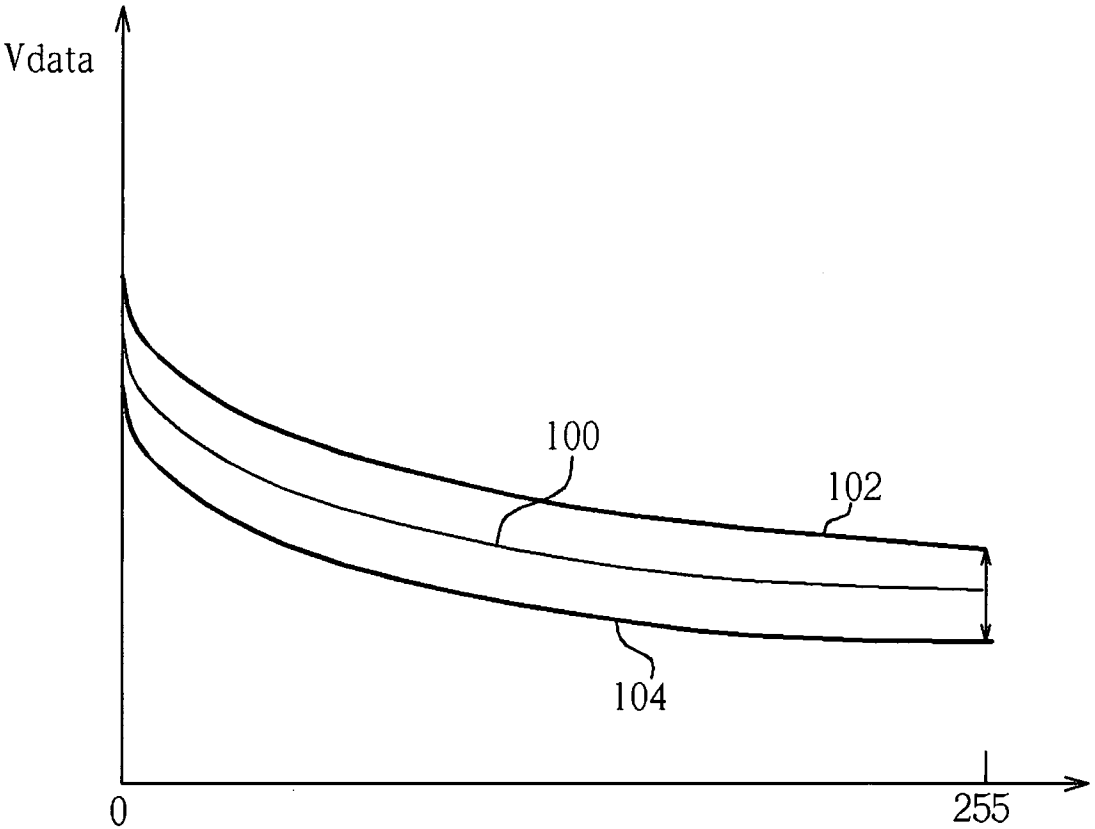
FIGS. 2 and 3 illustrate methods of adjusting the luminance of pixels during a white-point adjustment.
Figure 3:
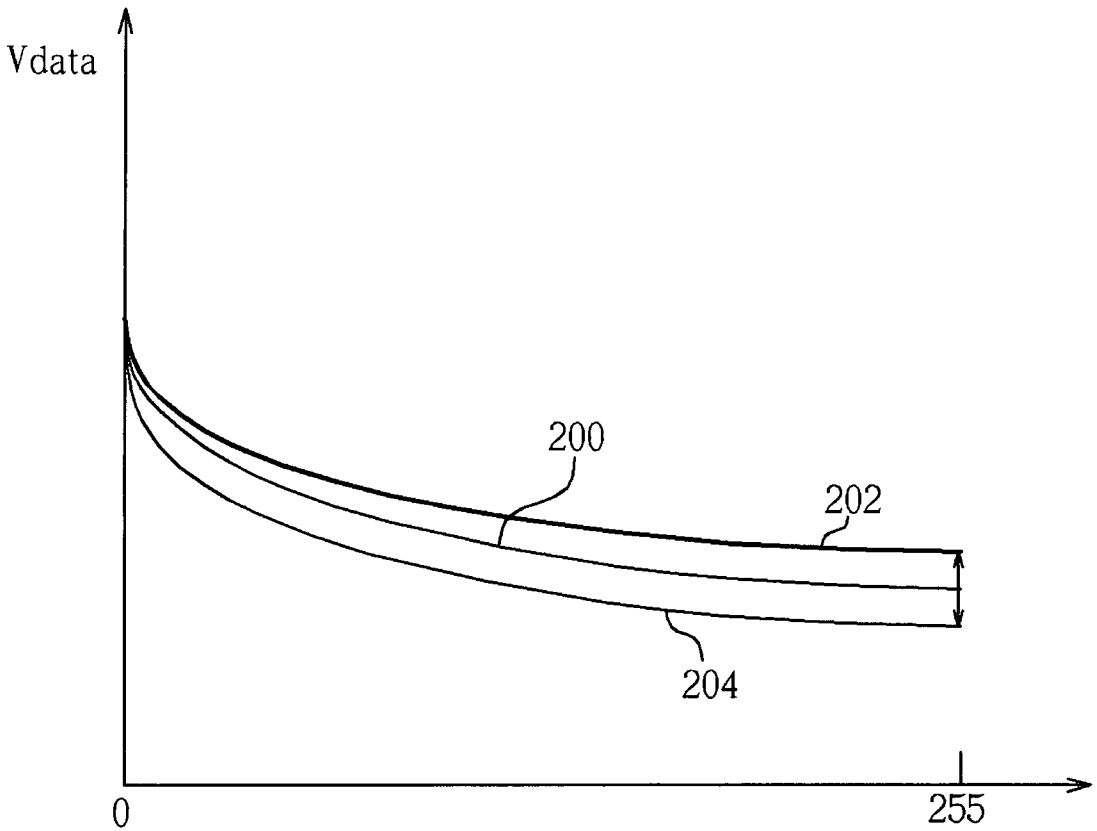

Please refer to FIGS. 2 and 3, which illustrate methods of adjusting the luminance of pixels 22 during a white-point adjustment. The graphs in FIGS. 2 and 3 show gamma curves which plot the driving voltage signal Vdata for subpixels versus the corresponding gray scale value. In some embodiments, according to different designs the gamma curves will be different. In FIG. 2, an offset value is added to or subtracted from an original gamma curve 100 to produce new gamma curves 102 and 104. This adjustment can be used, for example, to compensate for the different voltage thresholds of transistors that make up the AMOLED panel 20 in order to provide good contrast for the panel. Instead, as shown in FIG. 3, the slope of an original gamma curve 200 can be adjusted to become a new gamma curve 202 or 204 with a different slope. This adjustment can be used, for example, to compensate for the electroluminance variation of different AMOLED panels in order to improve the color and white-point performance of the panels. After the white-point adjustment is completed, the optimum display parameters are calculated. Please note that other types of adjustments can also be made to the panel for improving the color properties. In this way, each panel can be individually fine tuned to compensate for process variations, thereby ensuring optimum color characteristics for each panel.

Figure 4:
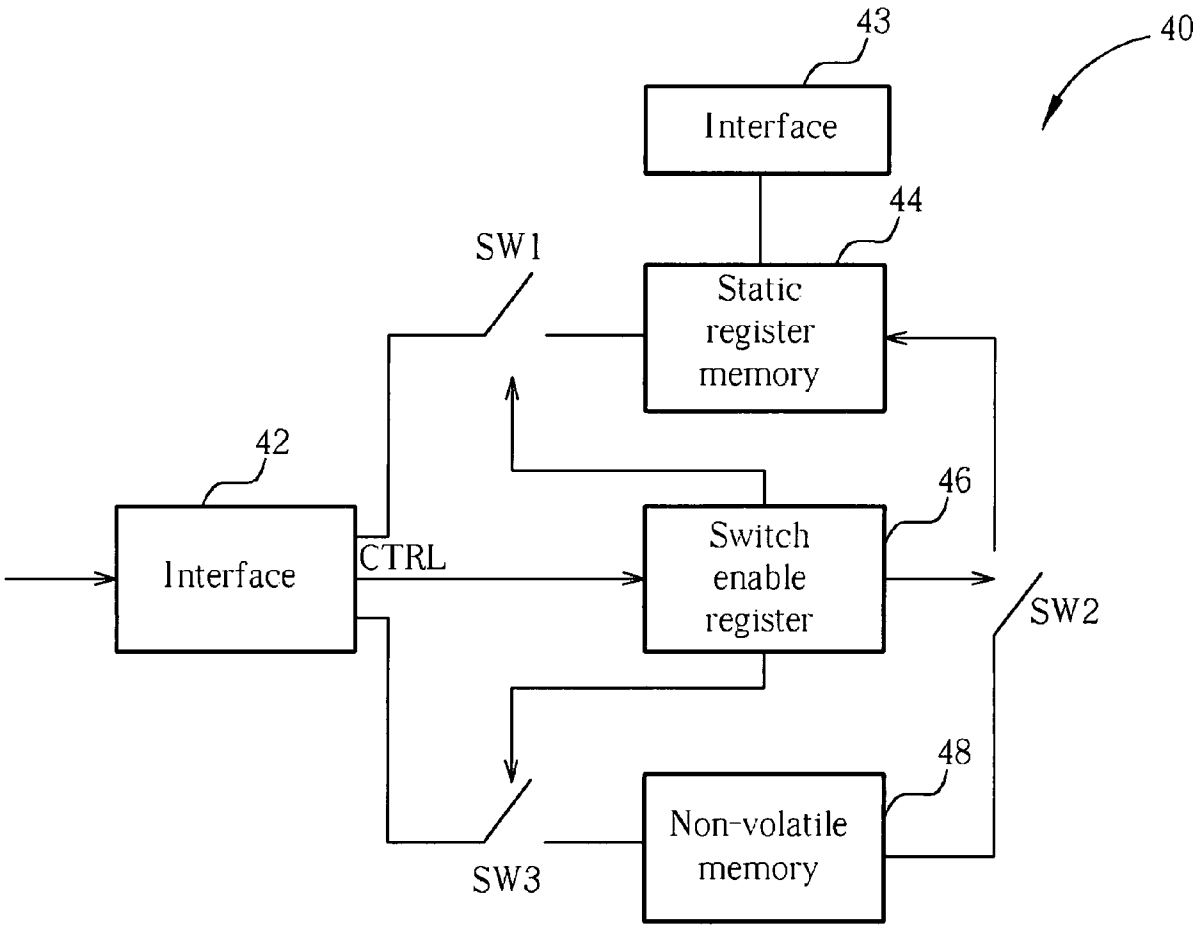
FIG. 4 is a detailed block diagram of the source driver circuit shown in FIG. 1.

Please refer to FIG. 4, which is a detailed block diagram of the source driver circuit 40 shown in FIG. 1. The source driver circuit 40 contains an interface 42 for receiving display information and an interface 43 for sending control signals to the source driver circuit 40. A static register memory 44 provides the display parameters to the interface 43 that are used for controlling the display parameters of the AMOLED panel 20. However, the display parameters stored in the static register memory 44 are set before the manufactured AMOLED panel 20 has been tested, and therefore are not the best display parameters used for displaying images on the AMOLED panel 20. To solve this problem, the source driver circuit 40 also contains a non-volatile memory 48 for storing the optimum display parameters obtained when performing the white-point adjustment for the pixels 22 of the AMOLED panel 20. When the AMOLED panel 20 is used during normal operation, the optimum display parameters are copied from the non-volatile memory 48 to the static register memory 44 so the AMOLED panel 20 has the best color characteristics for displaying data. To control the flow of data between the interface 42, the static register memory 44, and the non-volatile memory 48, the source driver circuit 40 also contains a switch enable register 46, which operates in response to a control signal CTRL received through the interface 42. The switch enable register 46 controls three switches SW1, SW2, and SW3 to open or close for writing data to the appropriate location. For instance, when the optimum display parameters are first stored in the non-volatile memory 48, switch SW3 is controlled to close so that the optimum display parameters can be written from the interface 42 into the non-volatile memory 48. During normal operation of the AMOLED panel 20, switch SW2 is closed so that the optimum display parameters are read from the non-volatile memory 48 and stored in the static register memory 44.

By having the static register memory 44 read the optimum display parameters from the non-volatile memory 48 when the AMOLED panel 20 is used during normal operation, the AMOLED panel 20 can display images with the best color quality possible. Furthermore, instead of using the same display parameters on each manufactured AMOLED panel 20, customized display parameters are used for each panel that is manufactured for ensuring that images have the best color.

By way of example, the interface 42 used in the source driver circuit 40 can be a serial peripheral interface (SPI) or an intelligent interface controller (IIC). The non-volatile memory 48 can be any type of memory that retains its values when power is not supplied, such as an erasable programmable read-only memory (EPROM), an electrically erasable programmable read-only memory (EEPROM), a flash memory, or a one-time programmable (OTP) memory.

In summary, the present invention AMOLED display stores optimum display parameters in a non-volatile memory for ensuring that the AMOLED panel is always operated with the best color characteristics. By using a non-volatile memory, the optimum display parameters are retained even when the AMOLED display is powered off.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of adjusting white point display parameters of an active matrix organic light emitting diode (AMOLED) panel, the method comprising:

obtaining an adjusted Gamma curve for all subpixels of all pixels of the AMOLED panel, wherein the adjusted Gamma curve for the subpixels of all pixels of the AMOLED panel is determined according to a white-point adjustment;

storing the adjusted Gamma curve in a non-volatile memory;

controlling a switch enable register to operate a first switch to load the adjusted Gamma curve for the subpixels of pixels of the AMOLED panel into the non-volatile memory, and upon completion of loading the adjusted Gamma curve for the subpixels of pixels of the AMOLED panel into the non-volatile memory, operating a second switch in order to load the adjusted Gamma curve stored in the non-volatile memory into a static register memory during normal operation of the AMOLED panel, the second switch having a first end directly connected to the non-volatile memory and a second end directly connected to the static register memory; and utilizing the adjusted Gamma curve loaded in the static register memory to drive the AMOLED panel to have optimum color properties while displaying image data.

2. The method of claim 1, wherein obtaining the adjusted Gamma curve for subpixels of the AMOLED panel comprises:

measuring subpixel color coordinates for sample subpixels of the AMOLED panel; and adjusting the brightness of the sample subpixels according to the measured color coordinate information of subpixels to achieve an optimum white-point for each pixel of the AMOLED panel.

3. The method of claim 2, wherein adjusting the brightness of sample subpixels comprises shifting red-green-blue (RGB) gamma curves using a predetermined offset value for all gray levels of the pixels of the AMOLED panel.

4. The method of claim 2, wherein adjusting the brightness of sample subpixels comprises adjusting the slope of red-green-blue (RGB) gamma curves for pixels of the AMOLED panel.

5. The method of claim 1, wherein the non-volatile memory is an erasable programmable read-only memory (EPROM).

6. The method of claim 1, wherein the non-volatile memory is an electrically erasable programmable read-only memory (EEPROM).

7. The method of claim 1, wherein the non-volatile memory is a flash memory.

8. The method of claim 1, wherein the non-volatile memory is a one-time programmable (OTP) memory.

9. The method of claim 1, wherein utilizing the adjusted Gamma curve loaded in the static register memory to drive the AMOLED panel to have optimum color properties while displaying image data comprises directly utilizing the adjusted Gamma curve to drive the AMOLED panel without altering the adjusted Gamma curve.

10. A system for adjusting display parameters of an active matrix organic light emitting diode (AMOLED) display, comprising:

an AMOLED panel comprising a plurality of pixels, each pixel comprising a plurality of subpixels;

a non-volatile memory for storing an adjusted Gamma curve for the subpixels of the AMOLED panel, wherein the adjusted Gamma curve for the subpixels of the AMOLED panel are determined according to a white-point adjustment;

a static register memory for loading the adjusted Gamma curve stored in the non-volatile memory during normal operation of the AMOLED panel;

a switch enable register for operating a first switch to load the adjusted Gamma curve for subpixels of the AMOLED panel into the non-volatile memory, and upon completion of loading the adjusted Gamma curve for subpixels of the AMOLED panel into the non-volatile memory, operating a second switch in order to load the adjusted Gamma curve from the non-volatile memory to the static register memory, the second switch having a first end directly connected to the non-volatile memory and a second end directly connected to the static register memory; and a source driver for utilizing the adjusted Gamma curve loaded in the static register memory to drive the AMOLED panel to have optimum color properties while displaying image data.

11. The system of claim 10, wherein the non-volatile memory is an erasable programmable read-only memory (EPROM).

12. The system of claim 10, wherein the non-volatile memory is an electrically erasable programmable read-only memory (EEPROM).

13. The system of claim 10, wherein the non-volatile memory is a flash memory.

14. The system of claim 10, wherein the non-volatile memory is a one-time programmable (OTP) memory.

15. The system of claim 10, wherein the non-volatile memory is integrated in the source driver.

16. The system of claim 10, wherein the source driver directly utilizes the adjusted Gamma curve to drive the AMOLED panel without altering the adjusted Gamma curve.

* * * * *